US005673436A

United States Patent [19]

Piper

[11] Patent Number: 5,673,436

[45] Date of Patent: Oct. 7, 1997

[54] DEFENSE GLOVE

[76] Inventor: Stan Piper, 9265 SW. Durham La., McMinnville, Oreg. 97128

[21] Appl. No.: 584,605

[22] Filed: Jan. 11, 1996

[51] Int. Cl.[6] ..... A41D 19/00; F41C 9/00

[52] U.S. Cl. ..... 2/160; 2/163; 2/905; 42/1.08; 42/1.11; 222/175

[58] Field of Search ..... 2/160, 159, 163, 2/905; 42/1.08, 1.09, 1.11, 84; 222/175, 192

[56] References Cited

U.S. PATENT DOCUMENTS

| | | | |
|---|---|---|---|
| 2,423,448 | 7/1947 | Haight | 42/1.11 X |
| 4,768,681 | 9/1988 | Dean et al. | 2/160 X |
| 4,907,297 | 3/1990 | Gallucci | 2/163 |
| 5,484,085 | 1/1996 | Bennett | 222/175 |
| 5,503,304 | 4/1996 | Keller et al. | 222/175 |

FOREIGN PATENT DOCUMENTS

| | | | |
|---|---|---|---|
| 3310155 | 9/1984 | Germany | 42/1.08 |

*Primary Examiner*—Peter Nerbun

[57] ABSTRACT

A glove for discharging an irritant in the face of an attacker is disclosed. A spray canister containing irritant is mounted on the glove on the back of the hand. A valve, electrically operated, is controlled by a pressure switch generally located on an index finger portion of the glove between the first knuckle and the second knuckle. The electrical power is provided by a battery mounted near the canister.

20 Claims, 3 Drawing Sheets

DEFENSE GLOVE

BACKGROUND OF THE INVENTION

1. Field of the Invention

This invention relates to the field of repellant devices operated by or on the hand.

2. Description of the Prior Art

A glove with a pocket on the palm for a mace canister is shown in U.S. Pat. No. 5,088,121. A canister covered with velcro is attached to a glove with velcro in the palm as shown in U.S. Pat. No. 4,504,980. An illuminating glove with a flashlight mounted on the back of the hand is shown in U.S. Pat. No. 4,625,339. A strap with a pocket for a mace canister fits around the hand in U.S. Pat. No. 4,477,005. A pencil holder is shown on the back of the hand in U.S. Pat. No. 3,629,867. A tear gas palm pistol is shown in U.S. Pat. No. 3,443,333.

The prior examples are defective when the attack comes from behind the victim. This requires the victim to turn around which may be impossible. What is needed is a readily operable canister pointable in any direction.

SUMMARY OF THE INVENTION

It is an object of the invention to provide a readily operable, easily accessible canister.

It is an object of the invention to provide an easily directable repellant spray.

A glove for discharging an irritant in the face of an attacker is disclosed. A spray canister containing irritant is mounted on the glove on the back of the hand. A valve, electrically operated, is controlled by a pressure switch generally located on the index finger between the first knuckle and the second knuckle. The electrical power is provided by a battery mounted near the canister.

DESCRIPTION OF THE PREFERRED EMBODIMENT

Figure 1:
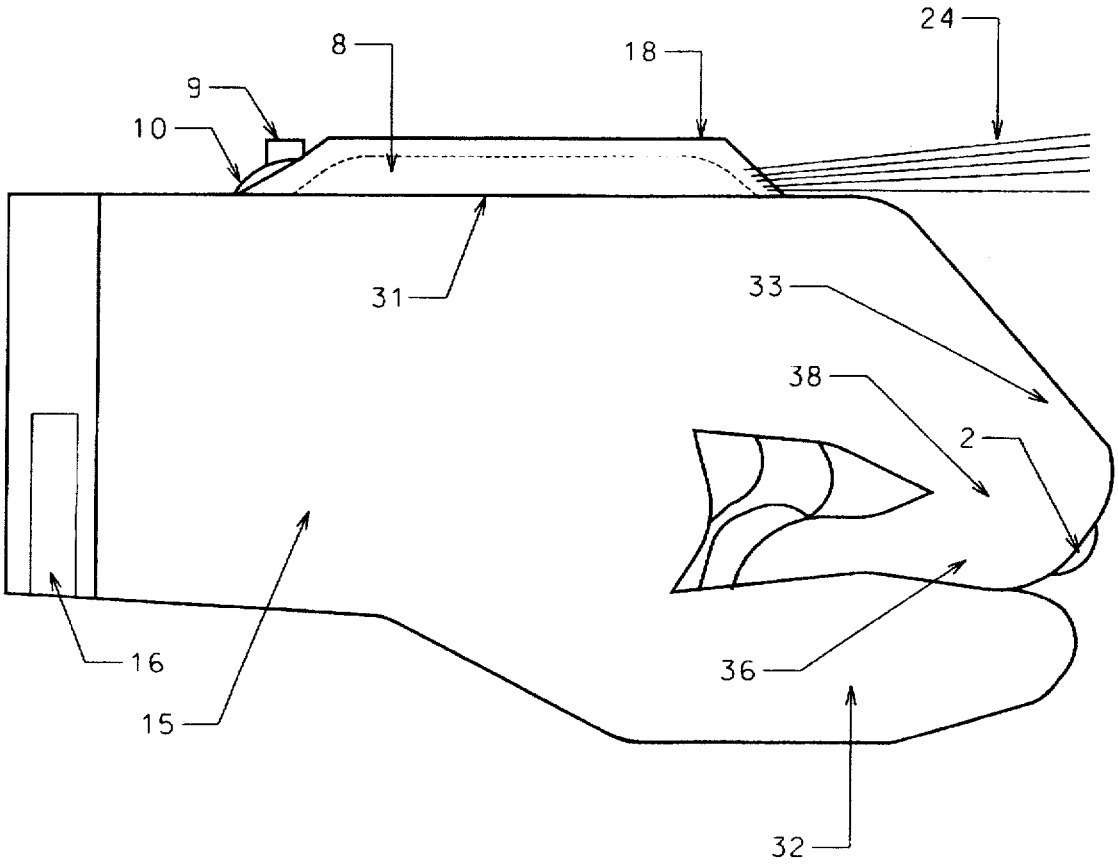
FIG. 1 is a side view of the invention.
Figure 2:
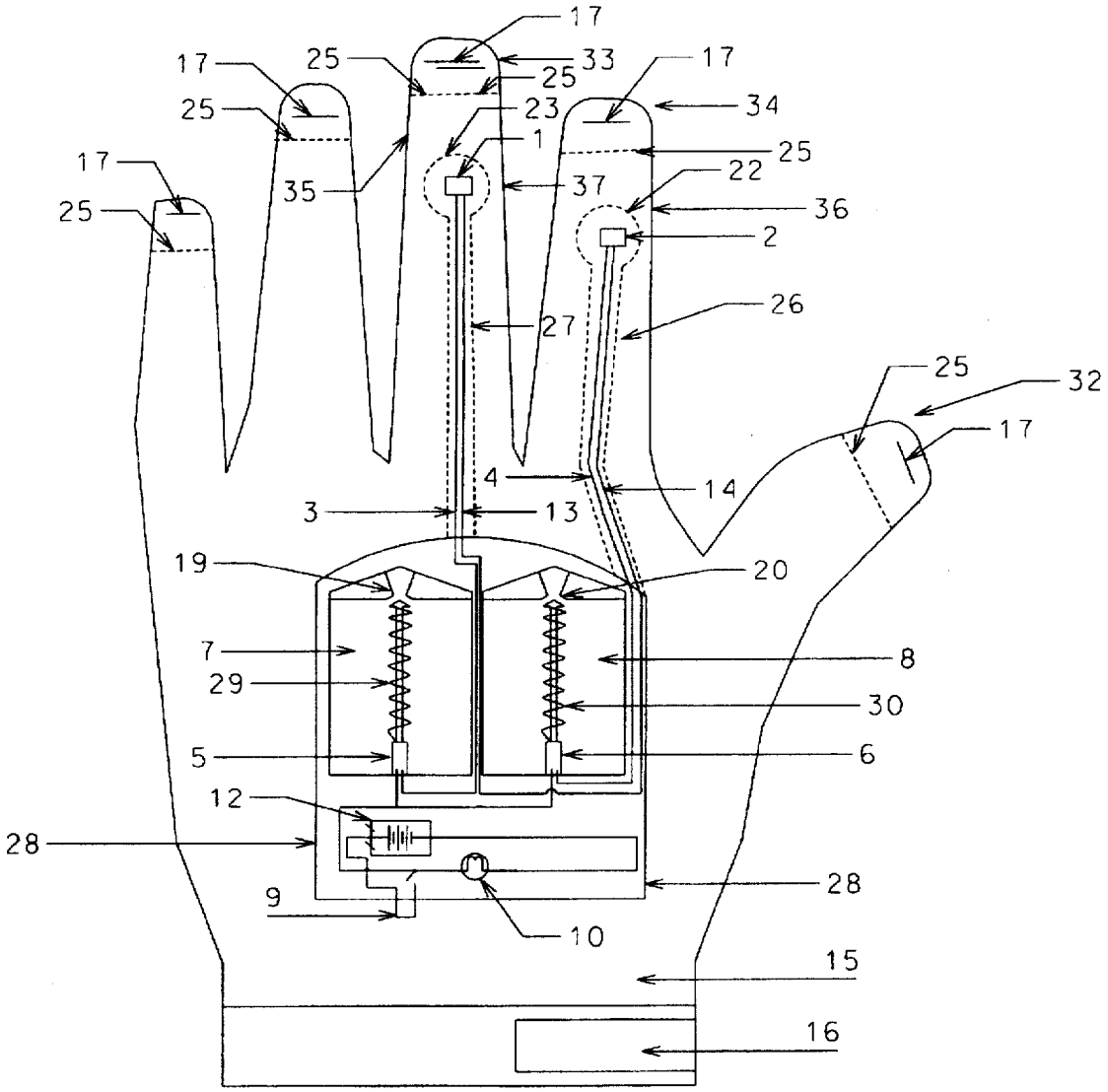
FIG. 2 is a top cut-away view of the invention.

FIG. 1 is a side view of the glove 15. The thumb, 32, can easily reach an index finger pressure switch 2 located on an index finger 34 of the glove, between the index finger first knuckle portion 36 and the index finger second knuckle portion 38. As seen in FIG. 2, pressure switch 2 is located on the back side of the glove finger portion 34. The glove 15 is held in place by means of VELCRO fastening means 16. On the back of the hand 31, pressurized canister 7 & 8, the on/off switch 9 and the LED light 10 are contained by the cover 18. A spray 24 is shown. Finger nail openings 17 are provided at the end of each finger portion of the glove. Finger tip cut-out portions 25 are represented by dashed lines. A flexible mounting base 28 is attached to the back of the glove. Canisters 7 & 8 are mounted thereupon.

Figure 4:
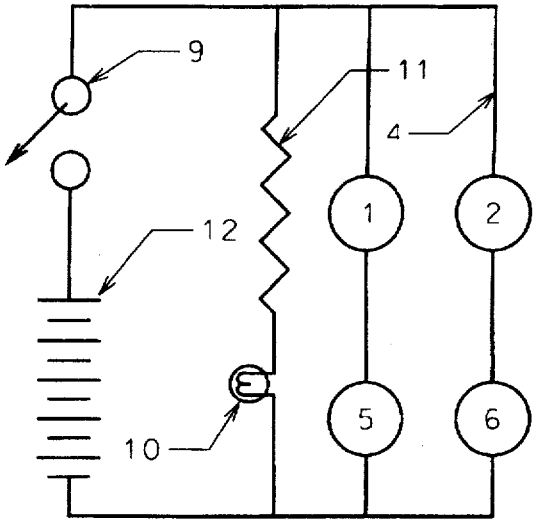
FIG. 4 is a circuit diagram of the invention.
Figure 5:
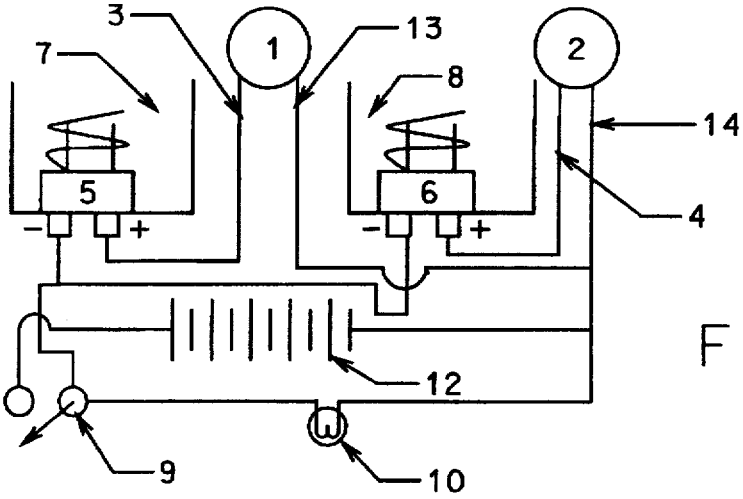
FIG. 5 is an enhanced view of the circuit diagram.

FIG. 2, 4, and 5 show the electrical operation of the invention. By activating either the pressure switches 1 or 2, the wires cause the canisters 7 or 8 to discharge. The power supply is a battery 12. A valve 5 or 6, preferred to be a solenoid, opens the discharge holes 19 or 20. The LED light 10 shows that the switch 9 is on. If the switch 9 is on and the LED light 10 is off, the battery 12 must be changed. However enough current remains to activate the canisters 7 & 8.

Figure 3:
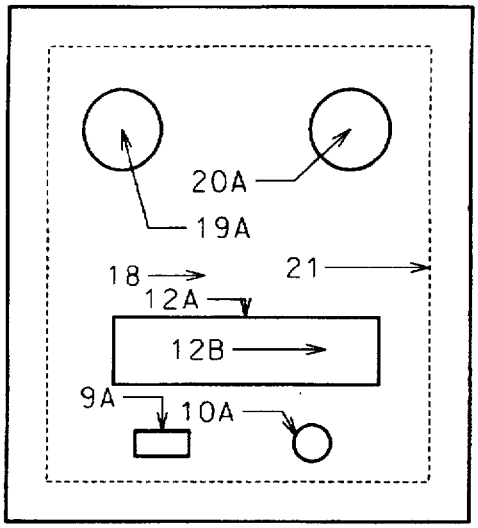
FIG. 3 is a top view of the cover.

FIG. 3 shows the cover 18 with the spray openings 19*a* and 20*a*. The battery lid 12*b* and battery opening 12*a* are shown. The on/off switch opening 9*a* and LED opening 10*a* are shown. The cover 18 is attached by cover stitching 21 to the glove 15.

FIG. 1 shows the operation of the invention. Note that the glove must be in the fist position to operate in order to prevent the irritant from spraying the victim's fingers.

I claim:

1. A self-defense device comprising:

a) a glove;

b) means for carrying an irritant mounted on said glove;

c) means for discharging said irritant; and d) means to activate said means for discharge of said irritant, said means including an element located on the back side of a glove finger portion so that the irritant may be discharged when said glove is in a fist position.

2. The device of claim 1, where said glove additionally comprises finger nail openings at the end of each finger.

3. The device of claim 1 where said glove additionally comprises finger tip cut outs.

4. The device of claim 1 where said means for carrying an irritant mounted on said glove comprises:

at least one canister placed on the glove on a back portion thereof; and a cover positioned over said at least one canister attached to said back of the glove.

5. The device of claim 4 where said canister is pressurized.

6. The device of claim 4 additionally comprising a flexible mounting base attached to said back portion of the glove and upon which a canister is mounted.

7. The device of claim 4 where two canisters are placed on the glove and said cover is positioned over both canisters said cover being attached to said back of the glove.

8. The device of claim 1 where said means for discharging said irritant comprise an electrically operated valve for opening a discharge hole in a canister.

9. The device of 8 where said valve is a fluid valve.

10. The device of 8 where said valve is solenoid operated.

11. The device of 8 where said canister is pressurized.

12. The device of claim 1 where said means to activate comprise:

a power source, a switch means; and wiring interconnecting said power source and said switch to activate said means for discharging said irritant.

13. The device of claim 12 where said switch means comprises at least one pressure switch.

14. The device of claim 13 where said pressure switch is on an index finger portion of the glove between a first knuckle portion and a second knuckle portion.

15. The device of claim 13 where said pressure switch is on a middle finger portion of the glove between a first knuckle portion and a second knuckle portion.

16. The device of claim 13 where two pressure switches are mounted one on an index finger portion of the glove and one on the middle finger portion of the glove.

17. The device of claim 12 where said power source is a battery mounted on a back portion of said glove.

18. The device of claim 12 wherein said switch means comprises an on/off switch.

19. The device of claim 18 additionally comprising an LED light.

20. The device of claim 19 where said LED light does not operate when said power source has low power, but said power source produces sufficient current to activate discharge of said irritant.

* * * * *